US005375100A

United States Patent [19]

Snape

[11] Patent Number: 5,375,100

[45] Date of Patent: Dec. 20, 1994

[54] GAS-OPERATED APPARATUS FOR MAKING A NOISE UNDER WATER

[75] Inventor: Timothy R. Snape, Abbotsbury, United Kingdom

[73] Assignee: Abbotsbury Software Limited, Abbotsbury, United Kingdom

[21] Appl. No.: 102,941

[22] Filed: Aug. 2, 1993

[51] Int. Cl.[5] ..... H04R 23/00

[52] U.S. Cl. ..... 367/143; 367/174; 367/910; 181/120

[58] Field of Search ..... 367/143, 174, 910; 181/120

[56] References Cited

U.S. PATENT DOCUMENTS

| | | | |
|---|---|---|---|
| 3,670,839 | 6/1972 | Savit | 367/143 |
| 3,721,311 | 3/1973 | Mott-Smith | 367/143 |
| 3,740,708 | 6/1973 | Phillips | 367/143 |

*Primary Examiner*—J. Woodrow Eldred

*Attorney, Agent, or Firm*—Iandiorio & Teska

[57] ABSTRACT

Gas-operated apparatus (2) for making a noise underwater, comprising a body (4), a diaphragm (6) which extends over the body (4) to define a chamber (8) between the body (4) and the diaphragm (6), a gas inlet nozzle (10) which extends into the chamber (8) and which engages an inner surface (12) of the diaphragm (6), and gas outlet means (14) for enabling gas in the chamber (8) to leave the chamber (8), the diaphragm (6) being made of an elastic material, the diaphragm (6) being such that it has an outer surface (16) which is in contact with a liquid, and the apparatus (2) being such that in use gas under pressure passes through gas inlet nozzle (10) and causes the diaphragm (6) to expand and collapse over a region of the diaphragm (6) that is in contact with the gas inlet nozzle (10) thereby to create noise which is adapted for optimum underwater transmission due to the diaphragm (6) being in contact with the liquid.

9 Claims, 5 Drawing Sheets

GAS-OPERATED APPARATUS FOR MAKING A NOISE UNDER WATER

This invention relates to gas-operated apparatus for making a noise under water.

Gas-operated apparatus for making a noise under water is known. One such known piece of apparatus is in the form of a horn which is operated by air pressure from an air tank of a scuba diver. The horn has a diaphragm which is caused to vibrate by the air and create noise. The diaphragm vibrates in an air environment in order that the horn can operate in air and in water. The effect of the diaphragm operating in an air environment is that when the horn is not submerged, noises created by the horn can be heard over long distances. However, when the horn is submersed in water, then the horn does not interface well with the water and the noise generated can only be heard over considerably reduced distances.

It is an aim of the present invention to provide gas-operated apparatus which is specifically constructed and designed for use under water and which enables noise generated to travel for considerable distances underwater.

Accordingly, in one non-limiting embodiment of the invention, there is provided gas-operated apparatus for making a noise underwater, which apparatus comprises a body, a diaphragm which extends over the body to define a chamber between the body and the diaphragm, a gas inlet nozzle which extends into the chamber and which engages an inner surface of the diaphragm, and gas outlet means for enabling gas in the chamber to leave the chamber, the diaphragm being made of an elastic material, the diaphragm being such that it has an outer surface which is in contact with a liquid, and the apparatus being such that in use gas under pressure passes through the gas inlet nozzle and causes the diaphragm to expand and collapse over a region of the diaphragm that is in contact with the gas inlet nozzle thereby to create noise which is adapted for optimum underwater transmission due to the diaphragm being in contact with the liquid.

The expansion and collapse of the diaphragm may be effective to generate noise at low frequencies. Such low frequency noise is not unpleasant for divers to hear and it does not tend to damage the hearing of divers. Thus the low frequency noise can be transmitted with high power over long distances under water without damage to the hearing of divers.

In one embodiment of the present invention, the apparatus is one in which the diaphragm is in direct contact with water in which the apparatus is being used, the liquid then being the water in which the apparatus is being used.

In another embodiment of the invention, the apparatus includes an outer housing, an external membrane which is connected to the outer housing and which is in contact with water when the apparatus is in use under water, and a liquid filled cavity formed between the outer housing and the external membrane, the liquid then being the liquid in the liquid filled cavity.

The liquid in the liquid filled cavity is preferably castor oil. Other liquids such for example as water may however be employed.

The apparatus of the invention may include pump means for modifying the liquid pressure in the liquid filled cavity. For example, the pump means may be employed to increase the pressure in the liquid filled cavity, thereby to decrease the frequency of the generated noise.

Usually, the diaphragm and the external membrane will be impedance matched for obtaining optimum sound transmission in the water.

The apparatus of the invention may include tension-adjuster means for adjusting tension in the diaphragm, Variations in the tension in the diaphragm can be employed to vary the frequency of the generated sound.

The tension-adjuster means may be screw ring member which is secured to a peripheral part of the diaphragm and which is able to be screwed along a threaded part of the body.

The apparatus of the invention may include gas inlet valve control means for controlling the rate of flow of gas through the nozzle. This control of the rate of flow of gas through the nozzle may determine the generated sound signal amplitude and frequency.

The apparatus of the invention may include gas outlet valve control means for controlling the gas pressure in the chamber. This control of the gas pressure in the chamber may be employed to vary the frequency of the generated sound.

The nozzle may comprise a flexible disc part which is able to be increased or decreased in size by gas pressure. The apparatus may include nozzle size valve control means for controlling the size of the flexible disc part.

It will be appreciated that various means may be employed for varying the frequency and/or amplitude of the generated sound in order to ensure that the generated sound is at a desired frequency, for example from 100 Hz to 8 KHz.

The apparatus of the invention may include gas flow restrictor means for ensuring that the gas cannot pass too quickly through the gas inlet nozzle in the event of a failure of part of the apparatus, for example in the event of a failure of the gas inlet valve control means which might otherwise allow a sudden rush of gas through the gas inlet nozzle and the generation of too loud a noise which might be damaging to a diver, for example to the diver's eardrums.

The apparatus of the invention may include outlet gas diffuser means for converting outlet gas passing through the gas outlet means into fine bubbles. Smoothing out the bubbles of the exhaust gas helps to stabilize back pressure and gives better acoustic signals and helps to avoid any tendency for a knocking noise to be generated.

The outlet gas diffuser means may be a bubble stone of the type used in aquariums.

The apparatus of the invention may include a source of gas.

The source of gas may be a source of air, or a source of any other suitable and appropriate gas such for example as carbon dioxide, nitrogen and steam. The source of gas can be a separate source of gas or it can be a diver's compressed air cylinder.

The apparatus of the invention may be produced in a variety of forms. Thus, for example, the apparatus of the invention can be used as diver communication and tracking apparatus. It can also be used as distance determining apparatus, for example for use by ships for determining how far away they are from a lighthouse. The apparatus of the invention can also be used as a hand held device for use by divers, for example in communicating with each other or for controlling dolphins. Still further, the apparatus of the invention can be used as a warning system for warning of the presence of submerged fishing nets. Still further, the apparatus of the invention can be used as a personal acoustic warning device, for example that is automatically activated if s persons should fall overboard from a ship. The personal acoustic warning device may be hydrostatically activated, activated on contact with water, or manually activated by the user.

Embodiments of the invention will now be described solely by way of example and with reference to the accompanying drawings in which.

Figure 1:
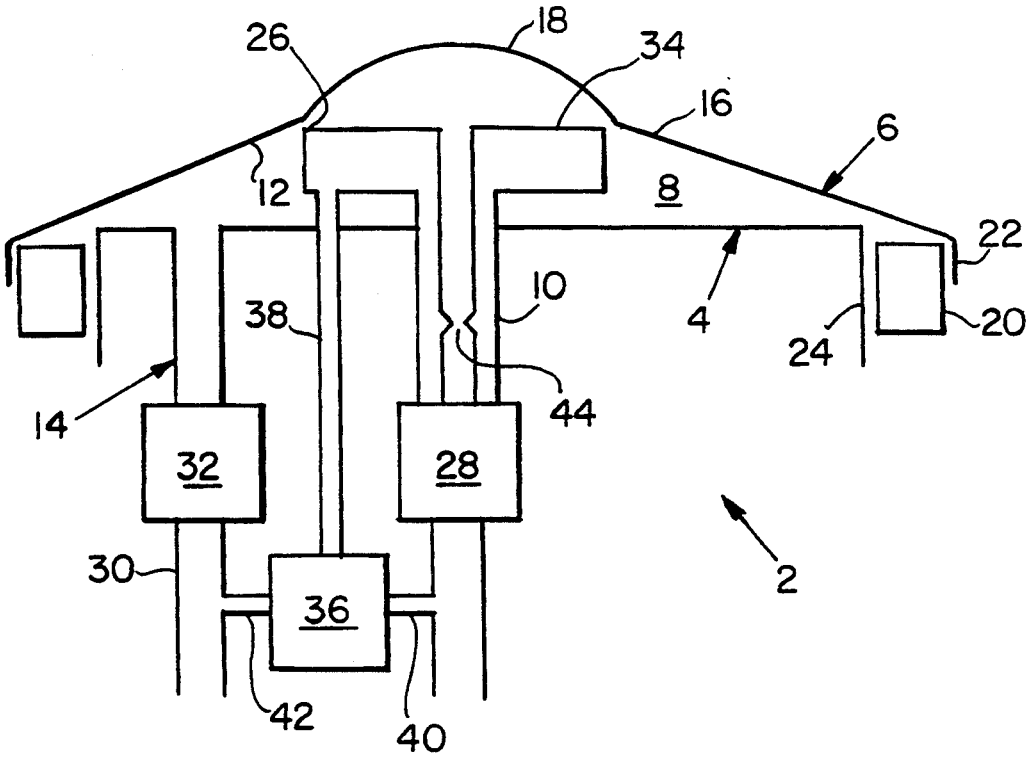
FIGS. 1 and 2 are similar cross sections through first gas-operated apparatus for making a noise under water.
Figure 2:
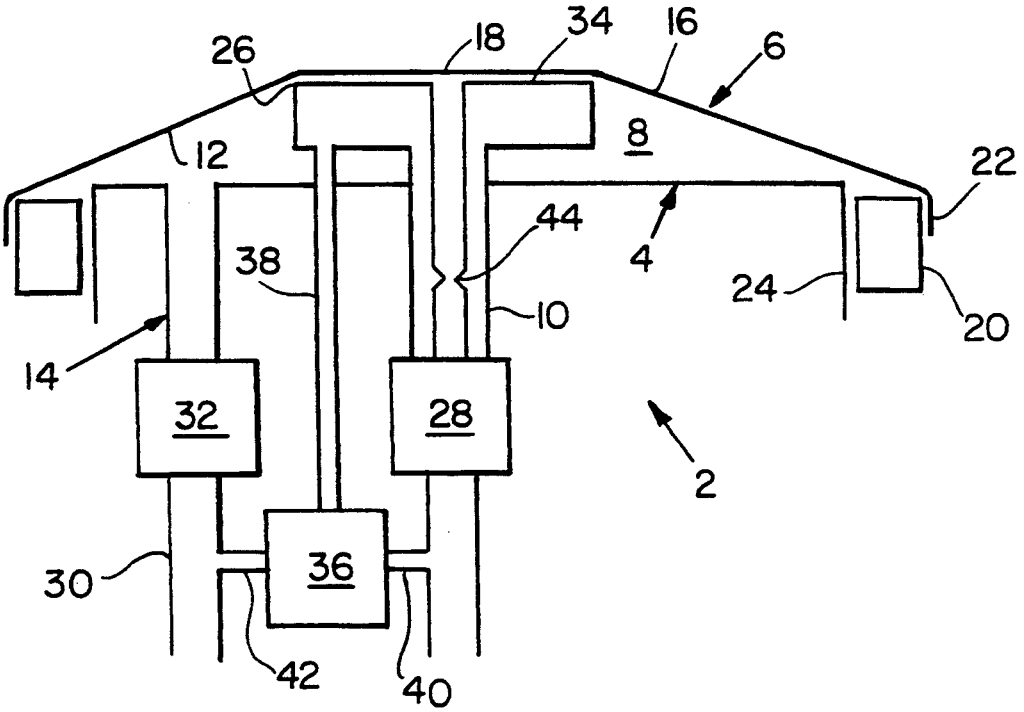

Referring to FIGS. 1 and 2, there is shown gas-operated apparatus 2 for making a noise underwater.

The apparatus 2 comprises a body 4, and a diaphragm 6 which extends over the body 4 to define a chamber 8 between the body 4 and the diaphragm 6. The apparatus 2 further comprises a gas inlet nozzle 10 which extends into the chamber 8 and which engages an inner surface 12 of the diaphragm 6. The apparatus 2 still further comprises gas outlet means 14 for enabling gas in the chamber 8 to leave the chamber 8. The diaphragm 6 is made of an elastic material. The diaphragm 6 is also such that it has an outer surface 16 which is in contact with water when the apparatus 2 is used under water.

The apparatus 2 is such that, in use, gas under pressure passes through the gas inlet nozzle 10 and causes the diaphragm 6 to expand and collapse over a region 18 of the diaphragm 6 that is in contact with the gas inlet nozzle 10 thereby to create noise which is adapted for optimum underwater transmission due to the diaphragm 6 being in contact with the water in which the apparatus 2 is being used. As can be seen from FIGS. 1 and 2, the diaphragm 6 is not enclosed so that the diaphragm 6 is in direct contact with the water in which the apparatus 2 is being used.

The apparatus 2 includes tension-adjuster means in the form of a screw ring member 20 which is secured to a peripheral part 22 of the diaphragm 6 and which is able to be screwed along a threaded part 24 of the body 4. Screwing the screw ring member 20 backwards and forwards along the threaded part 24 is effective to alter the tension in the diaphragm 6 and is thus effective to alter the frequency and sound of the noise generated.

The noise is actually generated by the gas passing along the gas inlet nozzle 10 and initially expanding the diaphragm 6 in the region 18 as can be seen by comparing FIGS. 1 and 2. After a while, the expansion of the region 18 gets so great that the diaphragm 6 moves off the edge 26 of the gas inlet nozzle 10. The expanded region 18 then collapses. The expansion and contraction of the region 18 generates the noise and the frequency of the noise generated can be varied by a number of ways including the above mentioned tension in the diaphragm 6.

The apparatus 2 includes gas inlet valve control means 28 for controlling the rate of flow of gas through the nozzle 10. This gas inlet valve control means 28 forms another way of varying the frequency and/or amplitude of the noise signals generated.

The gas outlet means 14 comprises a pipe 30 and a gas outlet control valve 32. Control of this valve 32 again is able to affect the sound generated by varying the frequency and/or the amplitude of the sound generated.

The apparatus 2 shown in FIGS. 1 and 2 is such that the gas inlet nozzle 10 has a flexible disc part 34 which is able to be increased or decreased in size by gas pressure. This increase or decrease in size of the flexible disc part 34 is effected using nozzle size valve control means 36. This valve control means 36 is a 3-way valve as shown and it is communication with the flexible disc part 34 by a pipe 38, is in communication with the gas inlet nozzle 10 by a pipe 40, and is in communication with the pipe 30 by a pipe 42.

The apparatus 2 includes a safety device in the form of a gas flow restrictor means 44. The gas flow restrictor means 44 is in the form of a constriction in the gas inlet nozzle 10. The gas flow restrictor means ensures that gas cannot pass too quickly through the gas inlet nozzle 10 and thus generate a sudden loud noise in the event of a failure of a part of the apparatus 2, for example a failure of the gas inlet valve control means 28. It will be appreciated that a sudden loud generation of noise could be dangerous to a diver in that it might startle the diver and/or might damage the diver's hearing.

Figure 3:
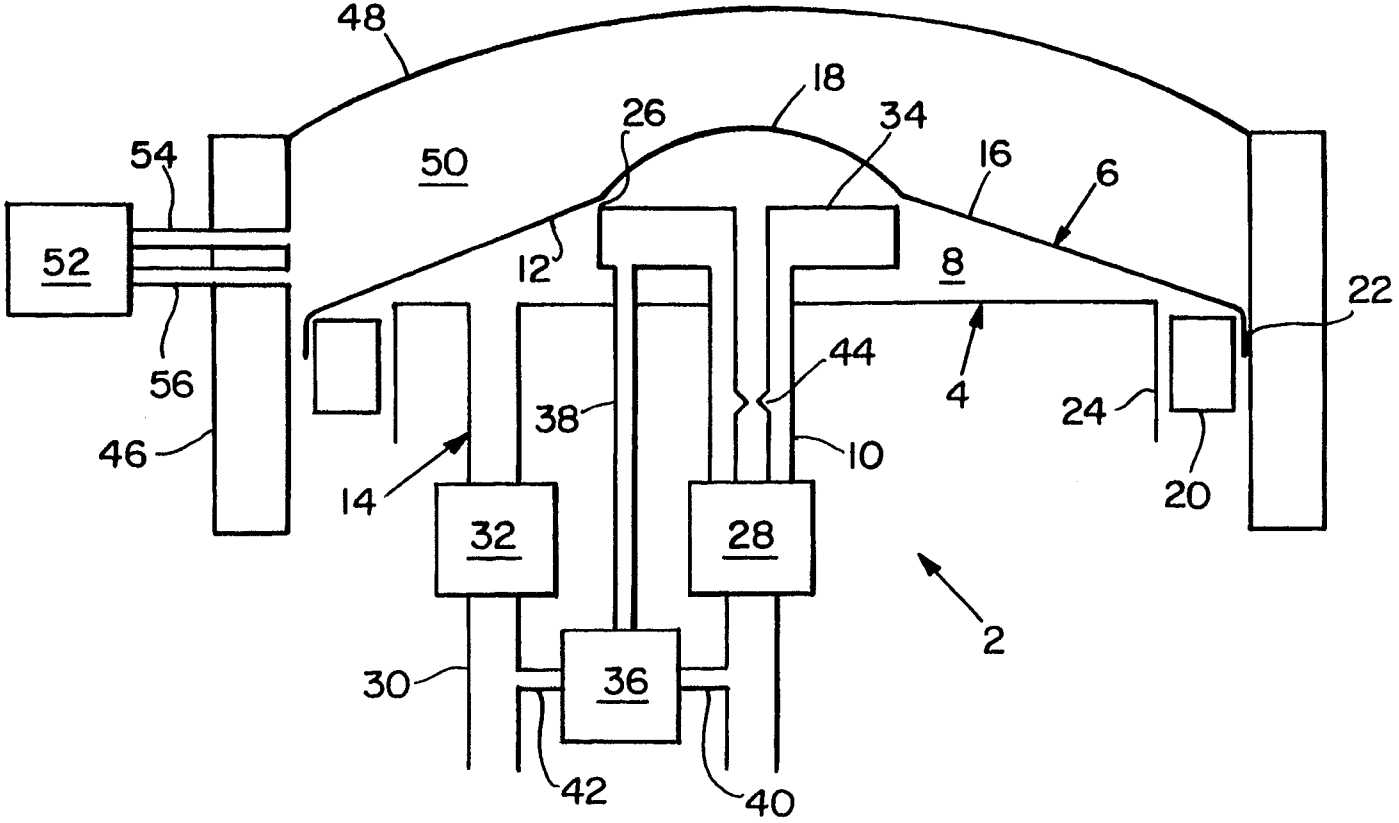
FIG. 3 is a cross section through second gas-operated apparatus for making a noise under water.

Referring now to FIG. 3, similar parts as in FIG. 2 have been given the same reference numerals for ease of comparison and understanding. In FIG. 3, it will be seen that the apparatus 2 includes an outer housing 46 and an external membrane 48 which is connected to the outer housing 46. The external membrane 48 is in contact with water when the apparatus is used underwater. A liquid-filled cavity 50 is formed between the outer housing 46 and the external membrane 48. The liquid in the liquid-filled cavity 50 is castor oil. The outer surface 16 of the membrane 6 is thus in contact with the castor oil. Sound generated by the expansion and contraction of the region 18 of the diaphragm 6 causes the generated sound to travel through the castor oil in the liquid-filled cavity 50, then to the external membrane 48 and then into the water in which the apparatus 2 is submerged.

The apparatus 2 shown in FIG. 3 includes pump means in the form of a pump 52 which is connected to the liquid-filled cavity 50 by pipes 54, 56. The pump 52 may be used to increase or decrease the liquid pressure in the liquid-filled cavity 50, thereby to modify the frequency and/or amplitude of the sound being generated. The diaphragm 6 and the external membrane 48 will usually be impedance matched.

During use of the apparatus 2 shown in FIGS. 1 and 2, high pressure air will enter the gas inlet nozzle 10, whilst low pressure air will leave the apparatus 2 via the gas outlet means 14. The gas inlet valve control means 28, the gas outlet control valve 32 and the nozzle size valve control means 36 may be controlled manually and/or they may be controlled externally by electrical and/or mechanical means.

Figure 4:
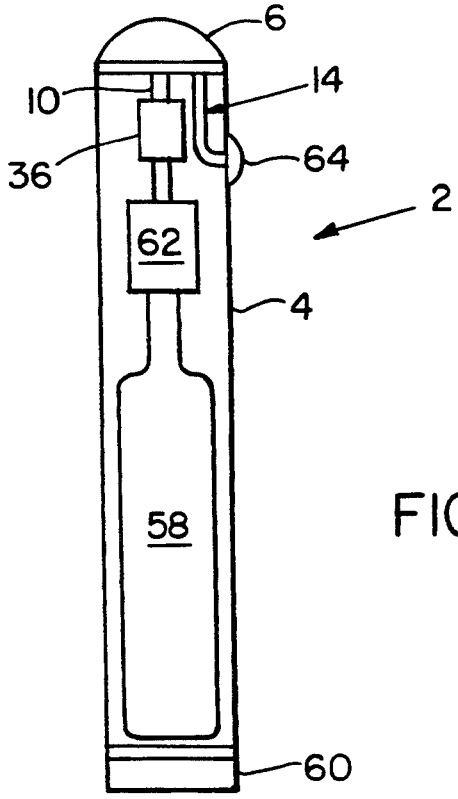
FIG. 4 shows third gas-operated apparatus for making a noise under water.

Referring now to FIG. 4, there is shown third gas-operated apparatus 2 for making a noise underwater. Similar parts as in FIGS. 1 to 3 have again been given the same reference numerals for ease of comparison and understanding.

As can be seen from FIG. 4, the apparatus 2 is in the form of a thin cylinder which can be held in a user's hand. The body 4 is in the form of a cylinder and it contains a source 58 of compressed gas. The body 2 has a screw on end cap 60 which enables the source 58 to be replaced as and when necessary. The apparatus 2 further has a pressure regulating device 62 for regulating the gas pressure leaving the source 58.

The gas outlet means 14 is provided with gas outlet diffuser means 64 for converting outlet gas passing through the gas outlet means 14 into fine bubbles. The diffusion of the exhaust gas bubbles helps to minimise on back pressure and gives better acoustic signals by helping to avoid a knocking noise being generated caused by the uncontrolled release of the exhaust gases.

Figure 5:
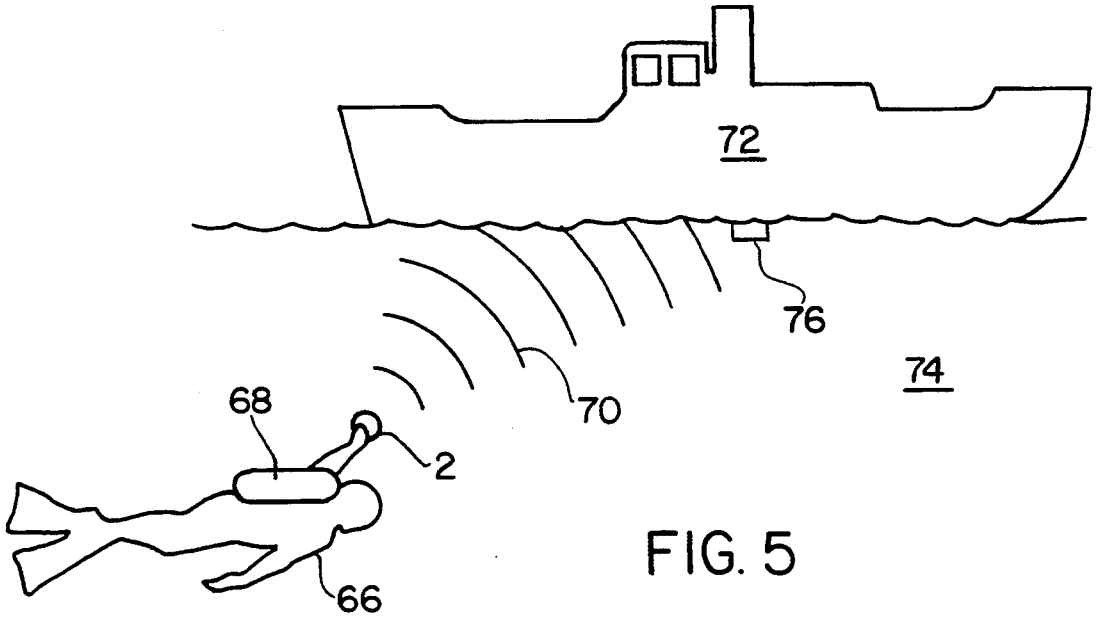
FIGS. 5–9 show different uses of the gas-operated apparatus of the present invention.

Referring now to FIG. 5, there is shown diver communicating and tracking apparatus. A diver 66 is shown with a compressed air cylinder 68 and apparatus 2, for example of the type shown in FIG. 4. The diver 66 is shown transmitting signals 70 to a ship 72 which is sailing on water 74. The diver 2 may in turn receive signals from the ship 72 which may be transmitted from a sonar transmitter 76.

Figure 6:
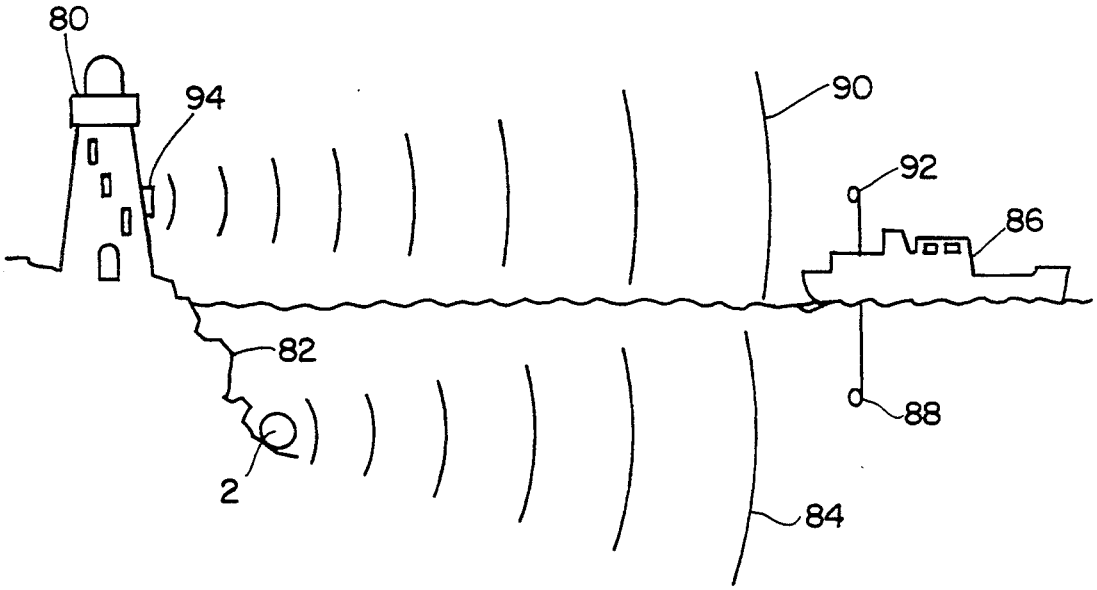

FIG. 6 shows a lighthouse 80 on a rock formation 82. Apparatus 2 such as the apparatus shown in any one of FIGS. 1 to 4 is shown transmitting signals 84. A ship 86 receives the signals 84 by a receiver 88. The lighthouse 80 transmits signals 90 to the ship 86 and these signals 90 are received by a receiver 92. The signals 84 travel in water and the signals 90 travel in air. The difference in the time of arrival at the receivers 88, 92 of the signals 84, 90 enables the distance of the ship 86 from the lighthouse 80 to be calculated. The signals 84 from the apparatus 2 and the signals 90 from a foghorn 94 are synchronised to operate together.

Figure 7:
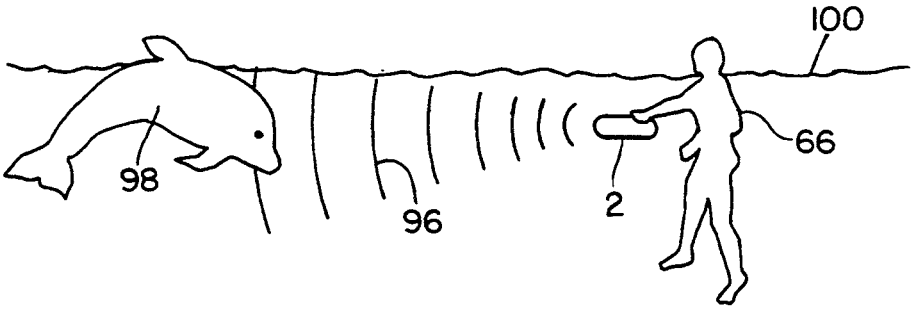

FIG. 7 shows a diver 66 using apparatus 2 to transmit an underwater signal 96 to a dolphin 98 swimming in water 100. The apparatus 2 can be used to communicate with dolphins for training or warning purposes so that the dolphins are able to swim clear of a hazard such for example as fishing vessels fishing for tuna fish.

Figure 8:
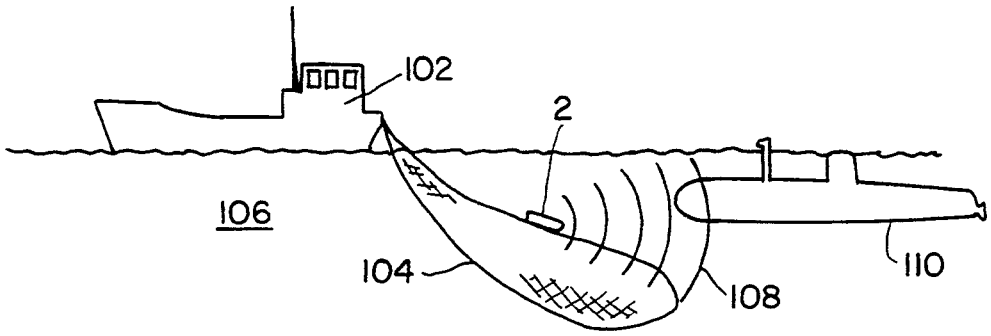

FIG. 8 shows a trawler 102 with a fishing net 104 being trawled in water 106. The fishing net 104 is provided with the apparatus 2 which sends out underwater acoustic signals 108. These signals 108 can be received by an underwater vessel such for example as the illustrated submarine 110 so that the submarine 110 will then not snag the fishing net 104 and possibly drag the trawler 102 into danger.

Figure 9:
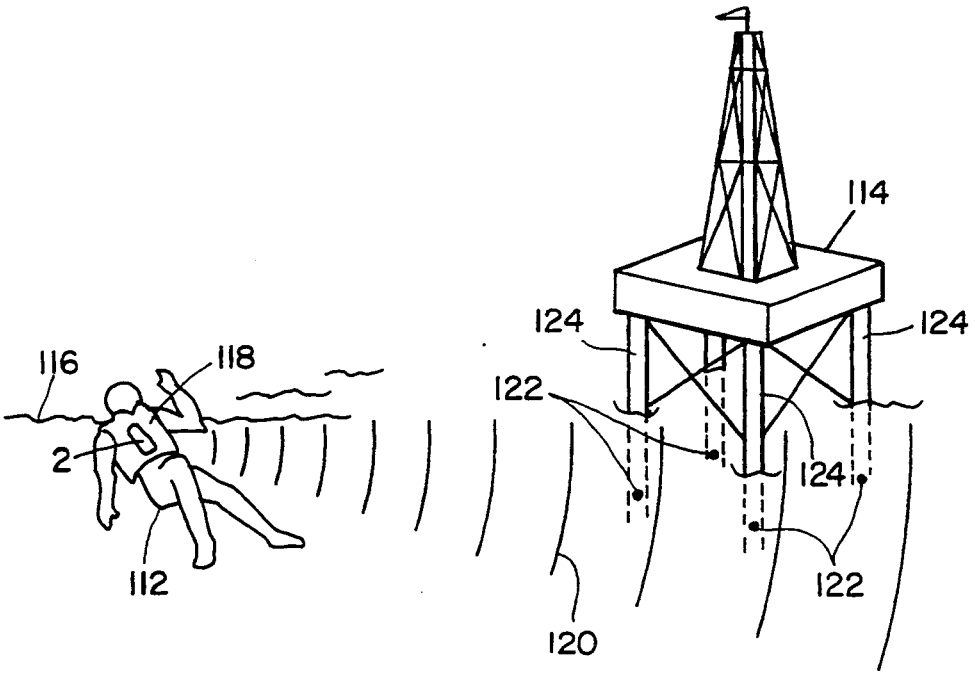

FIG. 9 shows a person 112 who has fallen from an oil rig 114 into water 116. The person 112 has a lifejacket 118 which is provided with the apparatus 2. The apparatus 2 is able to transmit underwater acoustic signals 128 which are received by receivers 112 mounted on legs 124 of the oil rig 114. The apparatus 2 in the embodiment shown in FIG. 9 can be arranged to be hydrostatically operated, or operated on contact with water or manually operated by the person 112. In either event, other persons on the oil rig 112 can be alerted to the fact that the person 112 has fallen in the water 116.

It is to be appreciated that the embodiments of the invention described above with reference to the accompanying drawings have been given by way of example only and that modifications may be effected. Thus, for example, in the embodiment shown in FIG. 5, the diver 66 may have an array of senses which may be used to calculate the bearing of the acoustic signals from the ship 72. The diver 66 can then transmit the signals 70 which will then be detected by the ship 72. The time delays between the transmission of the signals and receipt of the responses can then be used to calculate the distance between the diver 66 and the ship 72.

The apparatus 2 shown in FIG. 4 can be activated automatically by immersion in water, or it can be activated by an increase in hydrostatic pressure, or it can be activated by means of actuators interfaced to some external controlling means (not shown).

Instead of employing the screw ring member 20, other adjustable means can be employed for varying the tension in the diaphragm 6 to vary the number of times of expansion and collapsing of the region 18 per second. The material from which the diaphragm 6 is made and also its size, shape and thickness can also be used to vary the frequency and/or amplitude of the generated sound. The frequency and/or amplitude of the sound generated can also be varied by varying the external pressure. This can be achieved by changing the depth at which the apparatus 2 is operated at, or, alternatively, by using the apparatus 2 shown in FIG. 3 and employing the pump 52 as described above.

The apparatus 2 can also be used in applications other than those described above with reference to FIGS. 5–9. Thus, for example, the apparatus 2 could be employed to generate a noise like an engine of a vessel for any suitable and appropriate purpose. The apparatus 2 can also be used to generate a sound for activating or deactivating objects floating in water if desired.

The diaphragm may be made of any suitable and appropriate elastic material including rubber materials and plastics materials.

I claim:

1. Gas-operated apparatus for making a noise under water, which apparatus comprises a body, a diaphragm which extends over the body to define a chamber between the body and the diaphragm, a gas inlet nozzle which extends into the chamber and which engages a central part of the diaphragm, and gas outlet means for enabling gas in the chamber to leave the chamber, the diaphragm being made of an elastic material, the diaphragm being such that it has an outer surface which is in contact with a liquid and an inner surface which is in contact with the gas inlet nozzle, and the apparatus being such that in use gas under pressure passes through the gas inlet nozzle and causes the central part of the diaphragm repeatedly to expand and collapse thereby to create a train of noise pulses which is adapted for optimum underwater transmission due to the diaphragm being in contact with the liquid.

2. Apparatus according to claim 1 in which the diaphragm is in direct contact with water in which the apparatus is being used, the liquid then being the water in which the apparatus is being used.

3. Gas-operated apparatus for making a noise underwater, which apparatus comprises a body, a diaphragm which extends over the body to define a chamber between the body and the diaphragm, a gas inlet nozzle which extends into the chamber and which engages an inner surface of the diaphragm, and gas outlet means for enabling gas in the chamber to leave the chamber, the diaphragm being made of an elastic material, the diaphragm being such that it has an outer surface which is in contact with a liquid, the apparatus being such that in use gas under pressure passes through the gas inlet nozzle and causes the diaphragm to expand and collapse over a region of the diaphragm that is in contact with the gas inlet nozzle thereby to create noise which is adapted for optimum underwater transmission due to the diaphragm being in contact with the liquid, and the apparatus being such that it includes an outer housing, an external membrane which is connected to the outer housing and which is in contact with water when the apparatus is in use under water, and a liquid filled cavity formed between the outer housing and the external membrane, the liquid being the liquid in the liquid filled cavity.

4. Apparatus according to claim 3 in which the liquid in the liquid filled cavity is castor oil.

5. Apparatus according to claim 3 and including pump means for modifying the liquid pressure in the liquid filled cavity.

6. Apparatus according to claim 3 in which the diaphragm and the external membrane are impedance matched for obtaining optimum sound transmission in water.

7. Gas-operated apparatus for making a noise underwater, which apparatus comprises a body, a diaphragm which extends over the body to define a chamber between the body and the diaphragm, a gas inlet nozzle which extends into the chamber and which engages an inner surface of the diaphragm, and gas outlet means for enabling gas in the chamber to leave the chamber, the diaphragm being made of an elastic material, the diaphragm being such that it has an outer surface which is in contact with a liquid, the apparatus being such that in use gas under pressure passes through the gas inlet nozzle and causes the diaphragm to expand and collapse over a region of the diaphragm that is in contact with the gas inlet nozzle thereby to create noise which is adapted for optimum underwater transmission due to the diaphragm being in contact with the liquid, and the apparatus being such that it includes tension-adjuster means for adjusting the tension in the diaphragm.

8. Apparatus according to claim 7 in which the tension-adjuster means is a screw ring member which is secured to a peripheral part of the diaphragm and which is able to be screwed along a threaded part of the body.

9. Gas operated apparatus for making a noise underwater, which apparatus comprises a body, a diaphragm which extends over the body to define a chamber between the body and the diaphragm, a gas inlet nozzle which extends into the chamber and which engages an inner surface of the diaphragm, and gas outlet means for enabling gas in the chamber to leave the chamber, the diaphragm being made of an elastic material, the diaphragm being such that it has an outer surface which is in contact with a liquid, the apparatus being such that in use gas under pressure passes through the gas inlet nozzle and causes the diaphragm to expand and collapse over a region of the diaphragm that is in contact with the gas inlet nozzle thereby to create noise which is adapted for optimum underwater transmission due to the diaphragm being in contact with the liquid, and the apparatus being such that it includes gas inlet valve control means for controlling the rate of flow of gas through the gas inlet nozzle, gas outlet valve control means for controlling the gas pressure in the chamber, and gas flow restrictor means for ensuring that the gas cannot pass too quickly through the gas inlet nozzle in the event of a failure of part of the apparatus, and the gas inlet nozzle being such that it comprises a flexible disc part which is able to be increased or decreased in size by gas pressure, and nozzle size valve control means for controlling this size of the flexible disc part.

* * * * *